United States Patent [19]

Ito et al.

[11] Patent Number: 4,494,498

[45] Date of Patent: Jan. 22, 1985

[54] AIR-FUEL RATIO CONTROL SYSTEM FOR ENGINE STARTING

[75] Inventors: Tomoo Ito; Hiroshi Kamifuji, both of Katsuta; Haruhiko Kobayashi, Ibaraki; Tomiya Itakura, Katsuta, all of Japan

[73] Assignees: Hitachi, Ltd., Tokyo; Hitachi Automotive Engineering Co., Ltd., Ibaraki, both of Japan

[21] Appl. No.: 455,804

[22] Filed: Jan. 5, 1983

[30] Foreign Application Priority Data

Jan. 6, 1982 [JP] Japan ..... 57-168[U]

[51] Int. Cl.[3] ..... F02N 17/00

[52] U.S. Cl. ..... 123/179 G; 123/179 L

[58] Field of Search ..... 123/179 G, 179 L, 361, 123/362, 479, 403

[56] References Cited

U.S. PATENT DOCUMENTS

| | | | |
|---|---|---|---|
| 3,847,130 | 11/1974 | Miyoshi et al. | 123/179 G |
| 3,931,808 | 1/1976 | Rachel | 123/179 G |
| 4,157,084 | 6/1979 | Wallis | 123/179 L |
| 4,177,784 | 12/1979 | Tatsutomi et al. | 123/179 G |
| 4,187,821 | 2/1980 | Zebil | 123/179 G |

FOREIGN PATENT DOCUMENTS

| | | | |
|---|---|---|---|
| 115834 | 9/1981 | Japan | 123/179 G |
| 16240 | 1/1982 | Japan | 123/179 G |
| 2064009 | 6/1981 | United Kingdom | 123/179 G |

*Primary Examiner*—Parshotam S. Lall

*Attorney, Agent, or Firm*—Antonelli, Terry & Wands

[57] ABSTRACT

A fuel supplying system used in engine starting includes throttle valve means disposed in an intake air passage and metering valve means disposed in a fuel passage which extends from a fuel reservoir to a space of the intake air passage downstream from the throttle valve means. In order to obtain a required air-fuel ratio of a mixture determined in accordance with data representing states of an engine, in the fuel supplying system an opening degree of the throttle valve means which have a response delay is held constant and an opening degree of the metering valve means is adapted to be changed in accordance with a change of the required air-fuel ratio.

4 Claims, 2 Drawing Figures

AIR-FUEL RATIO CONTROL SYSTEM FOR ENGINE STARTING

BACKGROUND OF THE INVENTION

1. Field of the Invention

The present invention relates to a fuel supplying system used in engine starting and, more particularly, to a fuel supplying system adapted to be controlled by an electronic device.

2. Description of the Prior Art

In a conventional fuel supplying system the opening degree of a throttle valve is changed, in the start-up of the engine, i.e. at the time of cranking of the engine, in accordance with the engine temperature such that a predetermined negative pressure of, for example, −50 mmHg is generated in a space of an air passage downstream from the throttle valve. Namely, the effective voltage of the battery as the power source for the engine starter and the viscosity of the lubricating oil are the factors that influence the rotation speed of crank shaft during cranking and depend on the temperature of the engine. Thus, the rotation speed of the crank shaft during the cranking is changed essentially in accordance with the change in the engine temperature. In order to maintain a constant negative pressure in the space of the air passage downstream from the throttle valve, it is essential that the opening degree of the throttle valve is changed in accordance with the rotation speed of the crank shaft. To this end, the opening degree of the throttle valve is controlled in accordance with the engine temperature, because the rotation speed of the crank shaft depends on the engine temperature as explained before. Usually, the temperature of engine cooling water circulated in the engine is used as the index for the engine temperature.

In this fuel supplying system, it is necessary that the rate of fuel supply is changed in accordance with a change in the air flow rate so as to maintain a constant air-fuel ratio of the mixture induced into the engine. To make the most of the performance of this system, it is necessary to take into account various factors which influence the performance of this system such as an ability of the starter battery, a mixture pumping efficiency of the piston-cylinder combination working as a pump, a deterioration of the pumping efficiency, an engine temperature, and so forth. Accordingly a required labor is increased when the engine temperature is high, since a demanded opening degree of the throttle valve is large, it takes a long time until the throttle valve is opened to the demanded opening degree thereof, so that the cranking may be started before the demanded opening degree is provided. Furthermore, the electronic device for processing the aforementioned factors and for driving the aforementioned devices is required to have a large capacity and a complicated structure, resulting in increased manufacturing costs.

SUMMARY OF THE INVENTION

Accordingly, an object of the present invention is to provide a fuel supplying system in engine starting, capable of supplying the fuel at a stable air-fuel ratio during cranking and having a simple construction devoid of choke valve.

Other objects, features and advantages of the present invention will become clear from the following description of the preferred embodiments taken in conjunction with the accompanying drawings.

DESCRIPTION OF THE PREFERRED EMBODIMENTS

Figure 1:
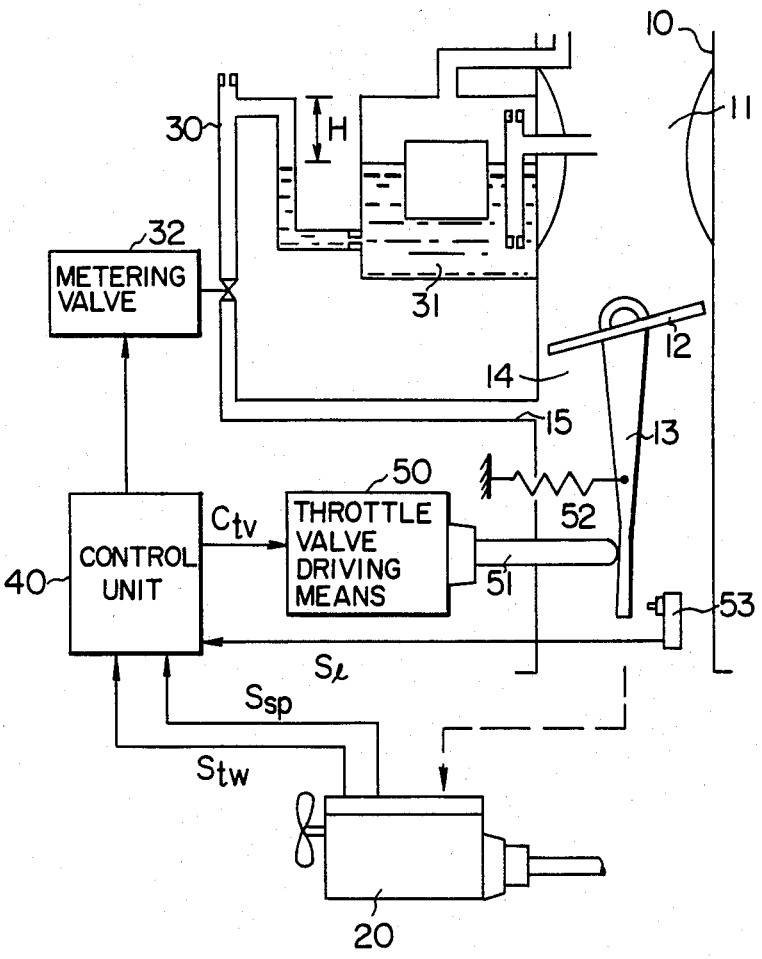
FIG. 1 is a block diagram of a fuel supplying system in accordance with a preferred embodiment of the present invention.

Referring to FIG. 1, an intake air passage 10 is provided through which air is introduced from an air cleaner into an internal combustion engine 20. The intake air passage 10 is provided with a venturi portion 11 into which the fuel nozzle projects and a throttle valve plate 12 downstream from the venturi portion. An operating rod 13, fixed to the throttle valve 12, is suitably driven to vary the inclination of the throttle valve plate 12 to thereby control an air passing area of the intake air passage 10 or an opening area of the throttle valve 12.

A starting fuel supply line 30 is provided through which fuel is supplied from a fuel reservoir 31 via a port 15 formed in a portion of a wall of the intake air passage 10 to a space 14 downstream from the throttle valve plate 12. The fuel supply line 30 includes a metering valve 32 a fuel passing area or an opening area of which is controlled by an ON-OFF type solenoid valve.

In starting up the engine, a negative pressure Pc is generated in the space 14.

The following formula is derived by applying the "Law of Conservation of Energy", i.e. the Bernoulli's theorem to the flow of air in the intake air passage 10 across the throttle valve 12:

$$\frac{1}{2}\rho V_u^2 + P_u + \rho g h_u = \frac{1}{2}\rho V_d^2 + P_d + \rho g h_d \tag{1}$$

where, $\rho$, V, P, g and h represent the density, speed, pressure, gravitational acceleration, and height, respectively. Subindexes u and d show the upstream side and downstream side of the throttle valve.

The formula (1) can be modified into the following formula (2):

$$\frac{1}{2}\rho(V_d^2 - V_u^2) = P_u - P_d + \rho g(h_u - h_d) \tag{2}$$

The following formula (3) is derived from the formula (2) because $V_u$, $P_u$ and $(h_u - h_d)$ can be regarded as being materially zero:

$$\frac{1}{2}\rho V_d^2 = -P_d \tag{3}$$

Then the following formula (4) is obtained by representing a weight of the sucked air per unit time, an opening area of the throttle valve and a pressure in the downstream space 14 in Qa, At and Pc, respectively:

$$\frac{1}{2}\cdot\frac{\rho}{g^2}\cdot\left(\frac{Qa}{At}\right)^2 = Pc \tag{4}$$

-continued $$\therefore Qa = \sqrt{\frac{2g^2}{\rho}} \cdot At \cdot \sqrt{Pc}$$

$$\therefore Qa = C_1 At \sqrt{Pc}$$

where, $C_1$ is a coefficient.

The following formula (5) is obtained by applying the "Law of Conservation of Energy", i.e. the Bernoulli's theorem to the flow of fuel in the fuel passage 30 across the metering valve 32 and making an approximation similar to that used in connection with the flow of air:

$$Qf = C_2 Al \sqrt{Pc} \quad (5)$$

wherein, $Q_f$ represents a weight of a fuel supplied per unit time, $C_2$ is a coefficient and Al is an opening area of the metering valve 32.

The following formula (6) is derived from the formulae (4) and (5) mentioned before:

$$Qa/Qf = \frac{C_1}{C_2} \cdot \frac{A_t}{Al} = C_3 \frac{A_t}{Al} \quad (6)$$

wherein $C_3$ represents a coefficient.

The left side Qa/Qf in formula (6) represents the air-fuel ratio of the mixture. From the formula (6), it will be understood that the air-fuel ratio is proportional to the opening area At of the throttle valve 12 and is in inverse proportion to the opening area Al of the metering valve. From this fact, it is understood that, instead of varying both of the areas At and Al for following up the change in the demanded air-fuel ratio Qa/Qf which varies in dependence upon the change in the engine temperature, the control may be made such that the value of the area Al solely is varied to follow-up the change in the air-fuel ratio while the area At is kept constant.

The fuel supply system of the embodiment described hereinbefore operates as follows:

A temperature sensor (not shown) is adapted to output a signal Stw representing the temperature of the cooling water which is used as an index of the temperature of the engine. Also, a signal Ssp representing the speed of revolution of the engine crank shaft is outputted by a speed sensor (not shown). These signals Stw and Ssp are delivered to a control unit 40.

The control unit 40 makes a judgement using the signal Ssp as to whether the engine is in the cranking state or not. If the engine is in cranking, the control unit 40 determines the required air-fuel ratio from the signal Stw. Then, in order to maintain the opening area of the throttle valve, i.e. the opening degree thereof, at a constant value, the control unit 40 delivers a throttle valve driving command Ctv to the throttle valve driving means 50. The throttle valve driving means 50 includes a motor, a reduction gear fixed to a rotary shaft of the motor, a threaded shaft fixed to the reduction gear and a rod 51 having an internal threaded hole making a screw engagement with the threaded portion of the threaded shaft. The motor of the driving means 50 is operated in accordance with the command Ctv from the control unit 40, so that the threaded shaft is rotated through the reduction gear. The rotation of the threaded shaft causes a movement of the driving rod 51 engaging therewith. Namely, as the driving means 50 receives the command Ctv, the driving rod 51 is moved to the right in FIG. 1, so that the operating rod 13 of the throttle valve 12 is rotated in the counter-clockwise direction against the biasing force of the tension spring 52 to a predetermined opening degree where the plunger of a limit switch 53 engages with the operating rod 13. As the throttle valve plate 12 is rotated to this position, the control unit 40 delivers a stop signal for stopping the driving means 50, upon receipt of a signal Sl from the limit switch 53, so that the motor is stopped to hold the throttle valve plate 12 at the predetermined opening position.

Figure 2:
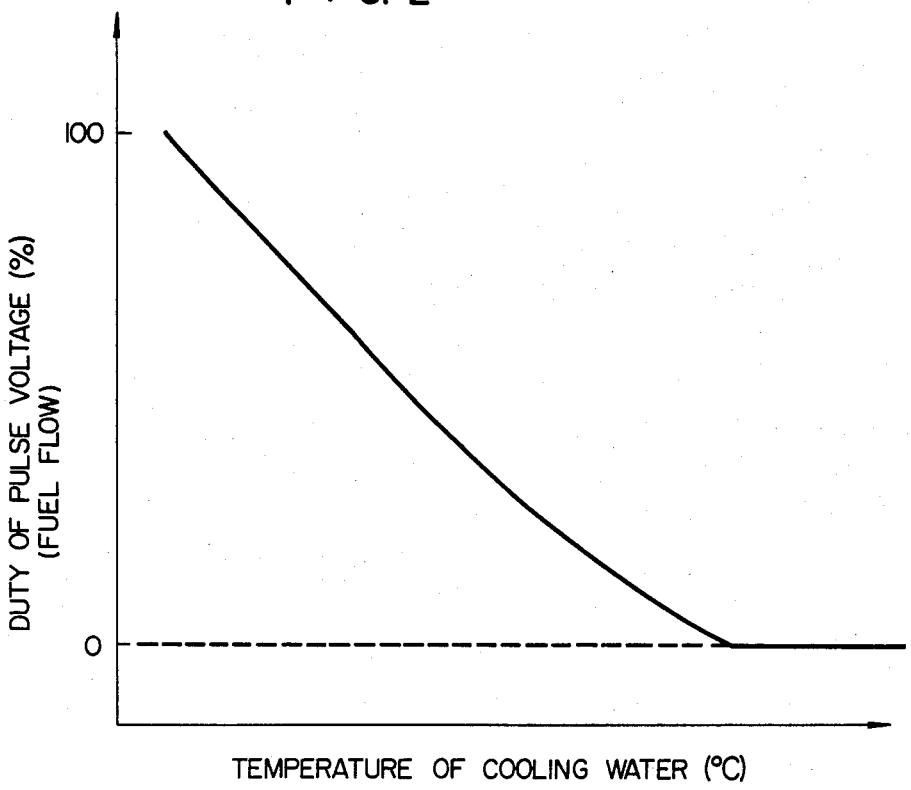
FIG. 2 is a diagram showing a relationship between a duty of a pulse voltage and a temperature of the cooling water

Then, the controller 40 determines the required air-fuel ratio using the signal Stw, i.e. the engine temperature. As stated before, in the system of the present invention, the throttle valve 12 is held at a constant opening. Namely, the opening area At is held constant. It is, therefore, necessary to vary the opening area Al of the metering valve 32 in order to achieve the required air-fuel ratio. The control of the change in the opening area Al is made by means of a series of pulses of voltage supplied from the control unit 40. Namely, the opening area Al is determined by the so-called duty time ratio which is the ratio of the valve open time to the one period of each pulse voltage. The control unit 40 includes a ROM (Read Only Memory) in which a relationship between the duty time ratio and the temperature of the cooling water shown in FIG. 2 is memorized. Namely, a value representing the duty time ratio for driving the ON-OFF type solenoid valve in the metering device 32 in accordance with the temperature of the cooling water is memorized in the ROM. The value is read out from the ROM and the pulse voltage series having a read out duty time ratio is delivered from the control unit 40 to the solenoid valve so as to provide the required opening area of the metering valve 32. For instance, supposing here that a pulse series consisting of 20 Hz pulses each having a period of 50 mS is supplied and that the high level of voltage lasts for 40 mS in each period, the duty ratio becomes 80%, so that the opening area Al of the metering valve becomes 80% of the total opening area. The duty time, i.e. the opening area Al, can be changed without delay by the control unit, so that the fuel supply system of the present invention can well respond to the change in the demanded air-fuel ratio even if such a change is drastic.

When the cranking speed is extremely low due to an exhaustion of the starter battery, the formula (5) should be modified more correctly as follows:

$$Q = C_2 \cdot Al \sqrt{Pc - Ph} \quad (5')$$

wherein Ph represents a fuel pressure head. The formula (5') represents the following fact. Namely, when the engine speed becomes extremely low and the absolute value of the negative pressure becomes small, it is not possible to neglect the pressure loss necessary for the fuel to flow over a height H which is provided for preventing wasteful leak of the fuel. In such a case, i.e. when the rotation speed of the engine does not reach the required speed of cranking, it is necessary to hold the throttle valve 12 at opening degrees which are smaller than that explained before. The number of these different opening degrees may be one or two.

As will be understood from the foregoing description, according to the present invention, it is possible to supply the air-fuel mixture at a stable air-fuel ratio however the environmental condition may be changed. In addition, since the metering valve solely is operated frequently, the number of steps to be processed in the control unit can be decreased as compared with the conventional one, which, in turn, permits the use of smaller memory and less-expensive elements than those used conventionally.

What is claimed is:

1. An air-fuel ratio control system used in engine starting, comprising:

a fuel passage through which a fuel is supplied from a fuel reservoir to a space of an air-fuel mixture passage downstream from a throttle valve disposed in said air-fuel mixture passage;

fuel metering valve means including a metering valve which is disposed within said fuel passage and adapted to meter the fuel to be supplied to said space of the air-fuel mixture passage;

valve driving means for driving said throttle valve to vary an opening degree thereof;

temperature sensing means for sensing a temperature of an engine cooling water;

speed sensing means for sensing an engine speed; and electronic control unit means for receiving data from said sensing means and delivering control signals to said fuel metering valve means and said valve driving means for driving and controlling said fuel metering valve means and said valve driving means such that said throttle valve is held in a constant predetermined opening degree by means of said valve driving means during engine warm-up while the opening degree of said metering valve is varied by said control unit means in dependence upon the change in the temperature of the engine cooling water.

2. An air-fuel ratio control system according to claim 1, wherein said metering valve is an ON-OFF two-position type solenoid valve which is driven by a series of pulse signals, a duty of each of which is controlled by said electronic control unit means.

3. An air-fuel ratio control system according to claim 2, wherein a value of said duty is determined by means of a ROM in the electronic control unit means in which the duties varying with the temperature of the engine cooling water are memorized.

4. An air-fuel ratio control system according to claim 1, wherein said predetermined opening degree of said throttle valve is determined by said electronic control unit means in accordance with the engine speed sensed by said speed sensing means.

* * * * *